US009022553B2

(12) United States Patent
Yamada

(10) Patent No.: US 9,022,553 B2
(45) Date of Patent: May 5, 2015

(54) PRINTER

(71) Applicant: Seiko Epson Corporation, Tokyo (JP)

(72) Inventor: Masahiko Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/104,293

(22) Filed: Dec. 12, 2013

(65) Prior Publication Data

US 2014/0184714 A1 Jul. 3, 2014

(30) Foreign Application Priority Data

Dec. 27, 2012 (JP) ..... 2012-284467

(51) Int. Cl.
*B41J 2/01* (2006.01)
*B41J 15/04* (2006.01)
*B41J 11/00* (2006.01)

(52) U.S. Cl.
CPC ..... *B41J 15/046* (2013.01); *B41J 11/006* (2013.01)

(58) Field of Classification Search
CPC ..... B41J 17/02; B41J 11/006; B41J 15/042; B41J 15/046
See application file for complete search history.

(56) References Cited

U.S. PATENT DOCUMENTS

| | | | | |
|---|---|---|---|---|
| 5,210,616 | A * | 5/1993 | Kawasaki et al. | 358/296 |
| 7,111,934 | B2 * | 9/2006 | Okuda et al. | 347/104 |
| 2004/0041331 | A1 * | 3/2004 | Sonoda et al. | 271/121 |
| 2009/0212494 | A1 | 8/2009 | Maeyama | |
| 2010/0220167 | A1 | 9/2010 | Nagata | |
| 2010/0244374 | A1 * | 9/2010 | Terada | 271/273 |

FOREIGN PATENT DOCUMENTS

| | | |
|---|---|---|
| JP | 2009-202978 | 9/2009 |
| JP | 2010-201680 | 9/2010 |

* cited by examiner

*Primary Examiner* — Shelby Fidler
*Assistant Examiner* — Tracey McMillion

(57) ABSTRACT

A printer has a paper feed roller and a pressure roller on the upstream side of a platen in the paper feed direction. These rollers nip the continuous paper at a nipping position. When the pressure roller bends down due to pressure from the paper feed roller, the pressure roller moves on a curved path centered on a pivot point of a paper pressing lever. The nipping position of the continuous paper therefore follows the downward movement of the paper feed roller and moves to the side away from the platen along the outside surface of the paper feed roller. The slope θ of the tangent to the nipping position therefore changes, the leading end of the continuous paper conveyed to the platen side rises, and slack in the continuous paper is removed.

5 Claims, 6 Drawing Sheets

PRINTER

BACKGROUND

1. Technical Field

The present disclosure relates to a printer that conveys the recording medium toward a platen using a paper feed mechanism including a paper feed roller and a pressure roller.

2. Related Art

The paper feed roller can be deflected by the pressure from the pressure roller in a printer that has a paper feed roller and a pressure roller on the upstream side of the platen in the paper feed direction. For example, when the conveyance path is wide and the pressure of the pressure roller is increased to increase the media conveyance force, deflection of the paper feed roller increases. In this event, the middle of the width of the recording medium that is pressed by the paper feed roller also bends and sags greatly. When the recording medium is fed to the platen while thus sagging, the middle of the width of the recording medium may catch on the platen and a paper jam may occur in front of (on the upstream side of) the platen.

A paper feed mechanism that conveys the recording medium while the paper feed roller is in a deflected state is disclosed in JP-A-2009-202978. The image reading device (scanner) taught in JP-A-2009-202978 causes the drive roller (paper feed roller) to bend to the downstream side in the conveyance direction. The left and right ends of the drive roller therefore slope from the ends in toward the center, and the paper can be conveyed without being wrinkled. Because the relative positions of the drive roller and driven roller (pressure roller) are thus offset in the paper conveyance direction at the center of the drive roller, the paper nipping position in the center of the drive roller moves down from the nipping position at the left and right ends of the drive roller. In JP-A-2009-202978, the driven roller is moved downstream in the conveyance direction according to the amount of deflection across the drive roller. As a result, the difference in the height of the nipping positions at the left and right ends of the drive roller and the nipping position in the middle of the drive roller is corrected, and downward deflection of the middle of the width of the paper is prevented. The leading end of the paper can therefore be prevented from catching on the image scanning unit.

The device taught in JP-A-2009-202978 eliminates variation in the nipping position resulting from the drive roller (paper feed roller) bending to the downstream side in the media conveyance direction, and thereby eliminates sagging in the paper, but does not align the height of the nipping positions when parts of the drive roller move up or down, and does not correct sagging in the paper caused by pressure from the driven roller causing the drive roller to bend to the downstream side. Furthermore, the height of the nipping position will change with deformation of the driven roller by simply moving the driven roller in the conveyance direction because the driven roller located in the middle of the drive roller is made from a flexible material, but if the driven roller is a roller that does not change shape, aligning the height of the nipping positions with this simple operation is difficult.

SUMMARY

A printer according to the present disclosure has a paper feed mechanism that can minimize deflection of the recording medium conveyed from the paper feed roller to the platen side even when the paper feed roller bends due to pressure from the pressure roller.

A printer according to one aspect of the disclosure comprises a printhead; a platen opposite the printhead; and a paper feed mechanism that conveys a recording medium between the printhead and the platen. The paper feed mechanism includes a paper feed roller disposed on the upstream side of the platen in the conveyance direction, a pressure roller that presses the recording medium to the paper feed roller to nip the recording medium at a nipping position, and a support mechanism that supports the pressure roller. When the paper feed roller moves in the direction of pressure applied by the pressure roller, the support mechanism moves the nipping position of the recording medium along the outside surface of the paper feed roller to the side away from the platen following the movement of the paper feed roller.

When the paper feed roller moves in the direction in which pressure is applied by the pressure roller, the nipping position of the recording medium follows this movement and moves to the side away from the platen along the outside surface of the paper feed roller. The angle of the recording medium at the nipping position therefore changes with the leading end of the recording medium protruding from the nipping position toward the platen moving in the opposite direction as the direction in which the paper feed roller is pressed by the pressure roller. Sagging of the continuous paper can therefore be reduced even when the paper feed roller bends by reducing the difference in the height of middle and the sides of the continuous paper before the platen. The continuous paper can therefore be prevented from catching on the platen, and paper jams can be prevented.

Preferably, the support mechanism includes a paper pressing lever to which the pressure roller is attached and which is supported pivotably on an axis of rotation parallel to the axis of rotation of the paper feed roller, and an urging member that urges the paper pressing lever in the direction pressing the pressure roller to the paper feed roller.

When the paper pressing lever pivots in the urging direction, the pressure roller moves along a curved path and moves the paper feed roller in the direction of the applied pressure. The nipping position can therefore be moved to the side away from the platen tracking the movement (descent) of the paper feed roller by means of a simple construction.

Further preferably, the nipping position is on the platen side of the axis of rotation of the paper feed roller; and the recording medium is conveyed toward the platen in the direction of the tangent to the paper feed roller at the nipping position.

This aspect of the disclosure feeds the recording medium from the nipping position to the platen surface at an angle, and can therefore prevent the recording medium from lifting away from the platen surface. Soiling the recording medium by contact with the ink nozzle surface of the printhead can therefore be prevented.

Further preferably, when the paper feed roller moves in the pressure direction of the pressure roller, the recording medium at the paper feed position directly before the platen moves opposite the pressure direction an amount corresponding to the amount of change in the direction of the tangent accompanying change in the nipping position; and the support mechanism supports the pressure roller so that movement of the recording medium at the paper feed position directly before the platen in the direction opposite the pressure direction due to change in the nipping position is equal to the movement of the paper feed roller by the pressure roller in the pressure direction.

When the paper feed roller bends, this aspect of the disclosure aligns the height of the middle and sides of the recording medium at the conveyance position immediately before the platen, and removes sagging in the recording medium. The recording medium is thus prevented from catching on the platen, and paper jams can be prevented.

Further preferably, a plurality of pressure rollers are disposed along the paper feed roller; a plurality of paper pressing levers are aligned and are disposed in the layout direction of the pressure rollers; the paper pressing levers pivot independently of one another but on a common axis of rotation. Each pressure roller is attached to one of the paper pressing levers.

When the paper feed roller bends, the paper pressing levers urged at different positions along the paper feed roller can pivot independently according to the deflection (bending) of the paper feed roller at the corresponding positions. The recording medium can therefore be moved in the opposite direction as the direction of the deflection an amount equal to the deflection in the paper feed roller at the same position. The recording medium can therefore be held at the same height across the width, and sagging in the recording medium can be reduced.

Effect of the Disclosure

When the paper feed roller moves in the direction in which pressure is applied by the pressure roller, the nipping position of the recording medium follows this movement and moves to the side away from the platen. The angle of the recording medium at the nipping position therefore changes with the leading end of the recording medium protruding from the nipping position toward the platen moving in the opposite direction as the direction in which the paper feed roller is pressed by the pressure roller. Sagging of the continuous paper can therefore be reduced even when the paper feed roller bends by reducing the difference in the height of middle and the sides of the continuous paper before the platen. The continuous paper can therefore be prevented from catching on the platen, and paper jams can be prevented.

Other objects and attainments together with a fuller understanding of the disclosure will become apparent and appreciated by referring to the following description and claims taken in conjunction with the accompanying drawings.

DESCRIPTION OF EMBODIMENTS

A preferred embodiment of a printer according to the present disclosure is described below with reference to the accompanying figures.

General Configuration

Figure 1:
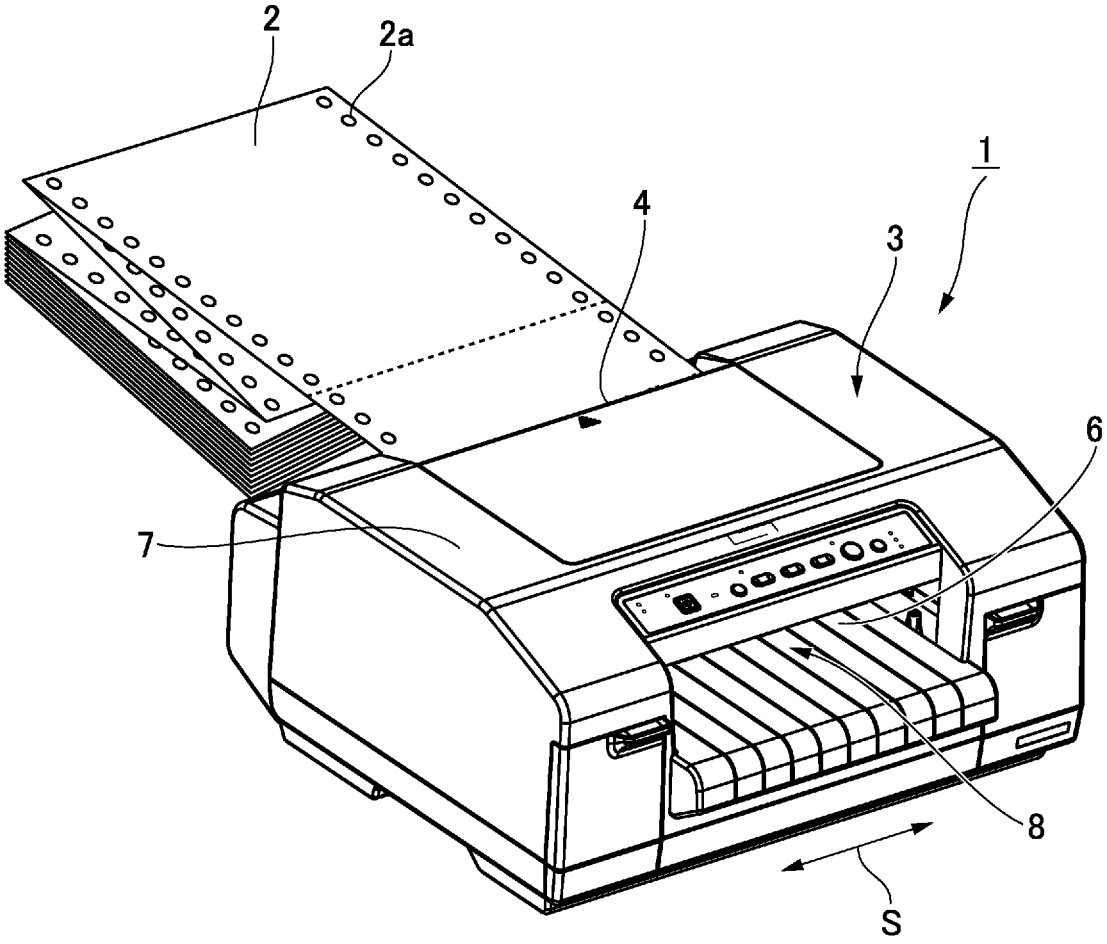
FIG. 1 is an oblique view of a printer according to the disclosure.
Figure 2:
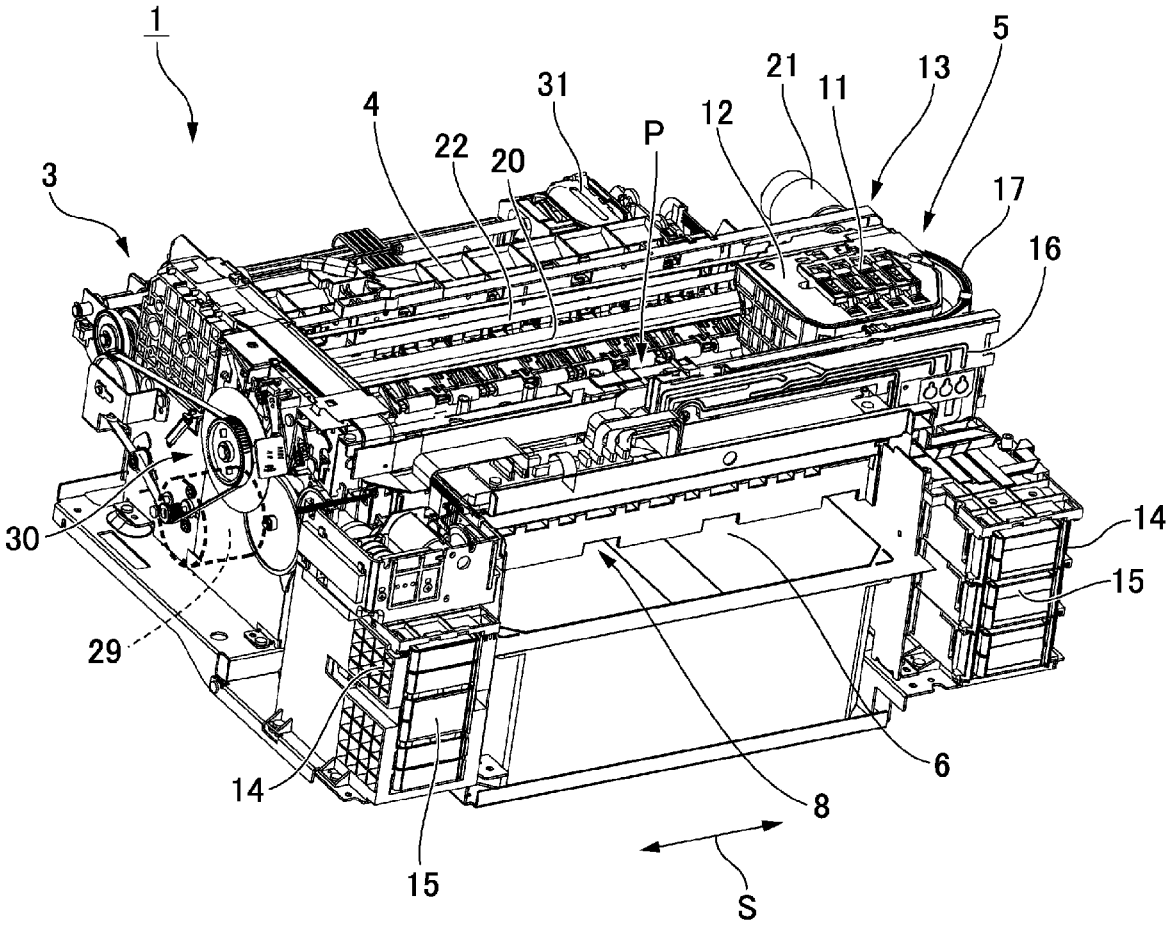
FIG. 2 is an oblique view of the printer with the outside case removed.

FIG. 1 is an oblique view of a printer according to a preferred embodiment of the disclosure. FIG. 2 is an oblique view from above one side of the width of the printer with the outside cabinet removed. The printer 1 according to this embodiment of the disclosure is an inkjet printer. The printer 1 pulls continuous paper 2 in from a paper supply entrance 4 at the back of the printer cabinet 3, prints on the continuous paper 2 (recording medium) at the print unit 5 (FIG. 2) inside the printer cabinet 3, and then discharges the paper from the paper exit 6 at the front of the printer cabinet 3. The continuous paper 2 in this example is fanfold paper having sprocket holes 2*a* along both sides of the paper width S. A conveyance path 8 for the continuous paper 2 is formed from the paper supply entrance 4 past the printing position P of the print unit 5 to the paper exit 6 inside the outside case 7 of the printer cabinet 3. The conveyance path 8 extends in a straight line between the front and back of the printer.

Figure 3:
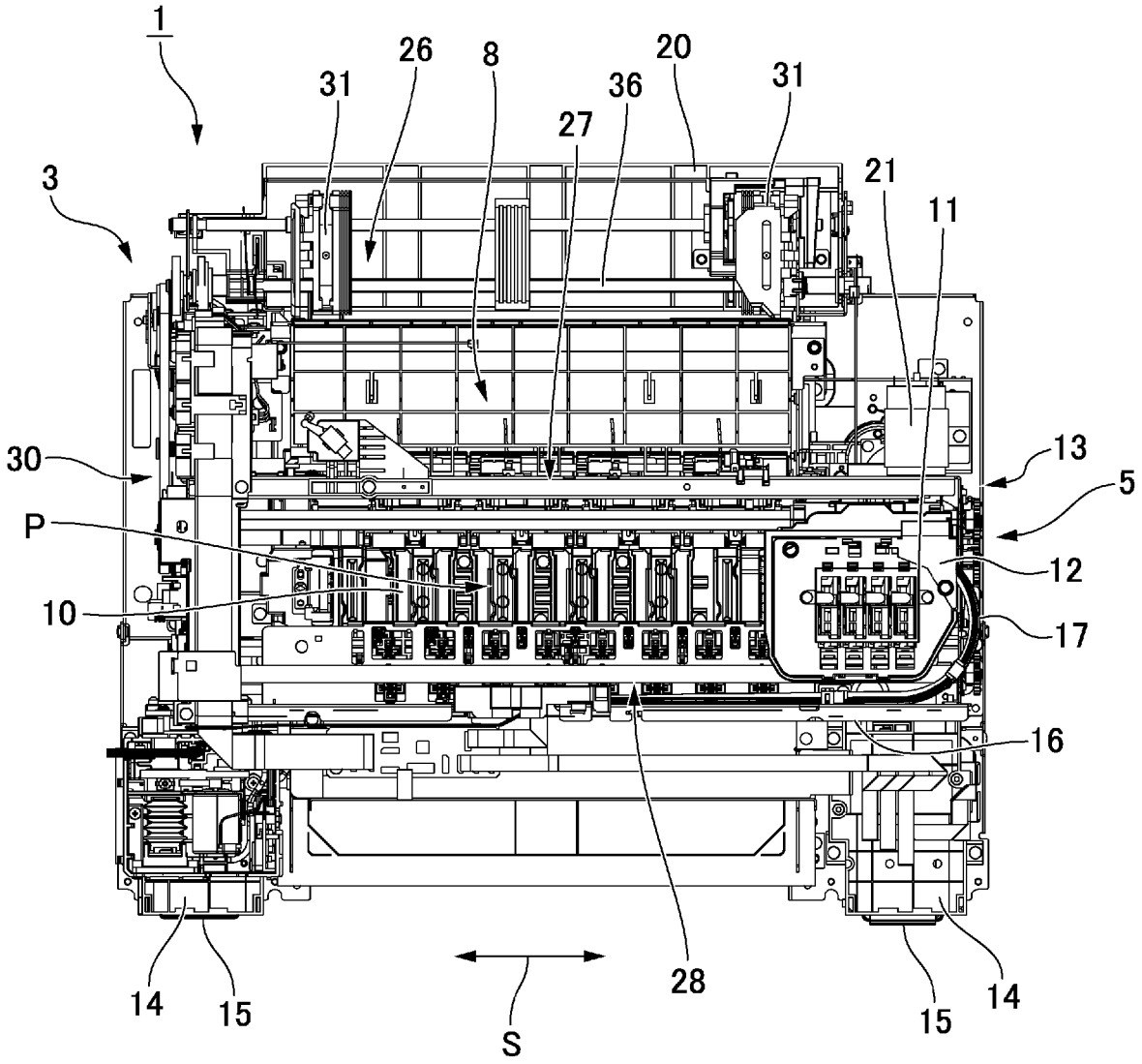
FIG. 3 is a plan view from above of the printer with the outside case removed.
Figure 4:
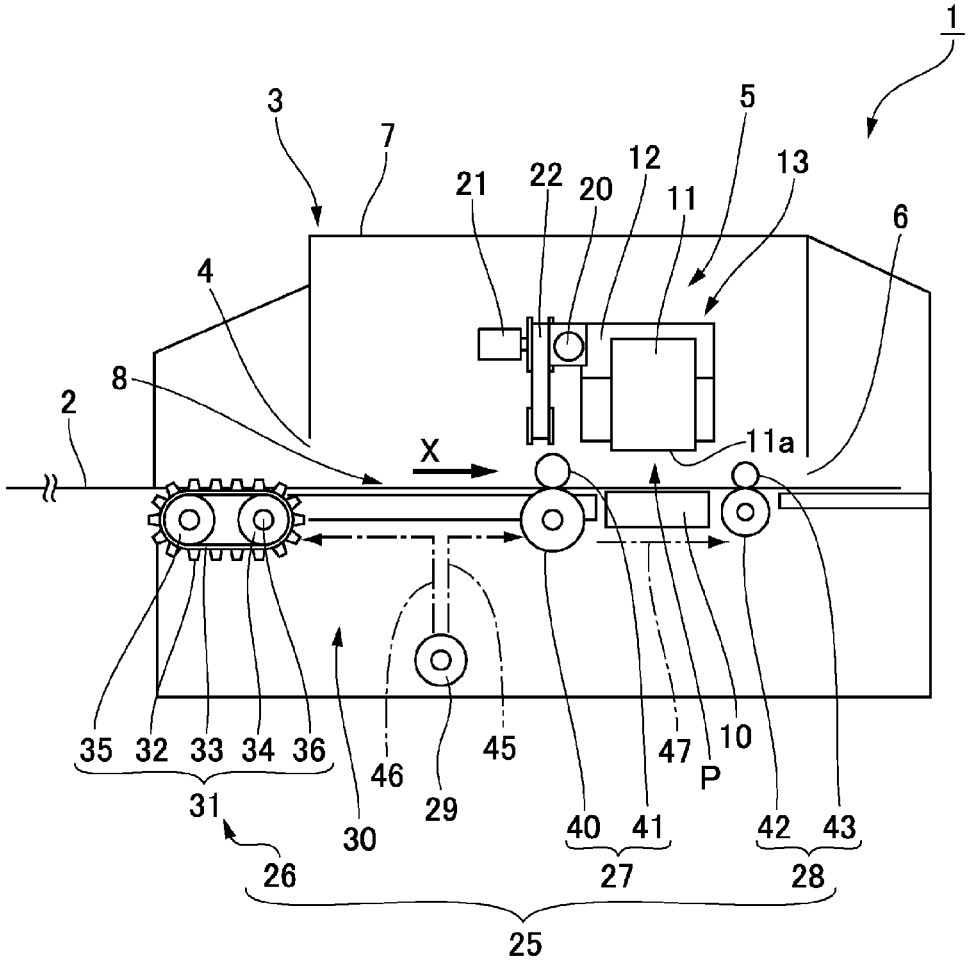
FIG. 4 describes main parts inside the printer.

FIG. 3 is a top plan view of the printer with the outside case removed. FIG. 4 describes the main parts inside the printer cabinet.

The print unit 5 includes a platen 10 that determines the printing position P, an inkjet head 11 (printhead), a carriage 12 that carries the inkjet head 11, and a carriage moving mechanism 13. The inkjet head 11 is mounted on the carriage 12 with the nozzle face 11*a* (FIG. 4) where the ink nozzles open facing the conveyance path 8. A cartridge loading unit 14 is disposed at the front of the printer cabinet 3 on each side of the printer width with the paper exit 6 therebetween, and ink is supplied to the inkjet head 11 through a plane supply path 16 and a flexible ink path 17 from a plurality of ink cartridges 15 removably installed in the cartridge loading units 14.

The carriage moving mechanism 13 has a carriage guide shaft 20 that extends widthwise perpendicularly to the direction of the conveyance path 8, a carriage motor 21, and a timing belt 22 that is driven by the carriage motor 21. The carriage 12 is supported by the carriage guide shaft 20 so that the carriage 12 can move along the carriage guide shaft 20. The carriage 12 is fixed to the timing belt 22, and when driven by the carriage motor 21 moves bidirectionally widthwise along the carriage guide shaft 20. When the carriage 12 moves along the carriage guide shaft 20, the inkjet head 11 moves bidirectionally in the paper width direction S at the printing position P.

As shown in FIG. 4, the printer 1 also has a conveyance mechanism 25 for conveying the continuous paper 2 through the conveyance path 8. From back to front, the conveyance mechanism 25 includes a first conveyance mechanism 26, second conveyance mechanism 27, and third conveyance mechanism 28. The printer 1 also has a paper feed motor 29 as the drive source of the conveyance mechanism 25, and a drive power transfer mechanism 30 that transfers drive power from the paper feed motor 29 to the conveyance mechanism 25.

The first conveyance mechanism 26 is a tractor unit disposed near the paper supply entrance 4, and has a pair of tractors 31. Each tractor 31 includes tractor pins 32, a tractor belt 33, a drive sprocket 34, a driven sprocket 35, and a tractor axle 36. The tractor pins 32 are engaging members that can enter the sprocket holes 2*a* in the continuous paper 2, and multiple tractor pins 32 are formed at a specific interval on the outside of the tractor belt 33. The tractor belt 33 is mounted on the drive sprocket 34 and driven sprocket 35.

As shown in FIG. 3, the pair of tractors 31 are disposed on opposite sides of the width of the conveyance path 8. Each tractor 31 is disposed to a position corresponding to the sprocket holes 2*a* on opposite sides of the width S of the conveyed continuous paper 2. The drive sprocket 34 of each tractor 31 is connected to the tractor axle 36, and the pair of tractors 31 can be driven synchronously.

The second conveyance mechanism 27 (paper feed mechanism) is disposed between the first conveyance mechanism 26 and the printing position P on the conveyance path 8, and more specifically close to the inkjet head 11. The second conveyance mechanism 27 includes a paper feed roller 40 and pressure roller 41 disposed with the axes of rotation aligned with the printer width, and a support mechanism 48 (not shown in FIG. 4) that supports the pressure roller 41. The pressure roller 41 is positioned to press the continuous paper 2 conveyed through the conveyance path 8 to the paper feed roller 40 from above.

The third conveyance mechanism 28 is disposed to the conveyance path 8 between the printing position P and the paper exit 6, and more specifically close to the inkjet head 11. The third conveyance mechanism 28 includes a discharge roller 42 and a pressure roller 43 disposed with the axes of rotation aligned with the printer width. The pressure roller 43 is positioned to press the continuous paper 2 conveyed through the conveyance path 8 to the discharge roller 42 from above.

The drive power transfer mechanism 30 includes a roller-side transfer mechanism 45 that transfers paper feed motor 29 rotation to the paper feed roller 40, and a tractor-side transfer mechanism 46 that transfers paper feed motor 29 rotation to the drive-side tractor axle 36. The drive power transfer mechanism 30 also includes a gear train 47. The gear train 47 synchronously drives the discharge roller 42 of the third conveyance mechanism 28 in the same direction and at the same conveyance speed as the paper feed roller 40 of the second conveyance mechanism 27.

The continuous paper 2 is set in the first conveyance mechanism 26 so that the tractor pins 32 are inserted to the sprocket holes 2*a*. When the paper feed motor 29 is then driven, the drive sprocket 34 is driven by the drive power of the paper feed motor 29, and the tractor belt 33 turns. As a result, the first conveyance mechanism 26 sequentially engages the tractor pins 32 with the sprocket holes 2*a* and conveys the continuous paper 2 to the conveyance path 8. When the paper feed motor 29 is driven, the paper feed roller 40 is also driven by the drive power of the paper feed motor 29. As a result, the second conveyance mechanism 27 conveys the continuous paper 2 fed by the first conveyance mechanism 26 to the conveyance path 8 together with the first conveyance mechanism 26. When the position for starting printing on the continuous paper 2 is set to the printing position P by feeding the continuous paper 2, the paper feed motor 29 stops. This completes indexing the continuous paper 2.

When the continuous paper 2 has been desirably positioned and the printer 1 receives print data supplied from an external device, the carriage motor 21 and inkjet head 11 are driven. As a result, the inkjet head 11 executes a single-pass printing operation (printing operation) that ejects ink droplets onto the continuous paper 2 while moving in one direction across the paper width S. When the single-pass printing operation ends, the paper feed motor 29 is driven and a paper feed operation that advances the paper a specific distance is executed. The printer 1 prints the print data by alternately repeating this single-pass printing operation and the paper feed operation.

Figure 5:
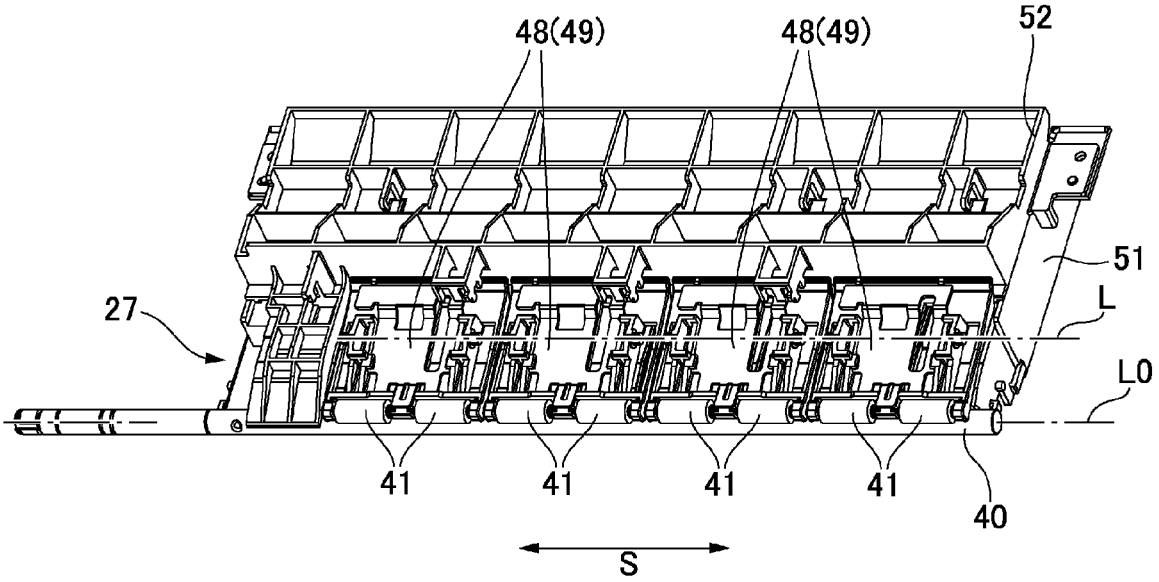
FIG. 5 is an oblique view of the second conveyance mechanism, top paper guide, and bottom paper guide.
Figure 6:
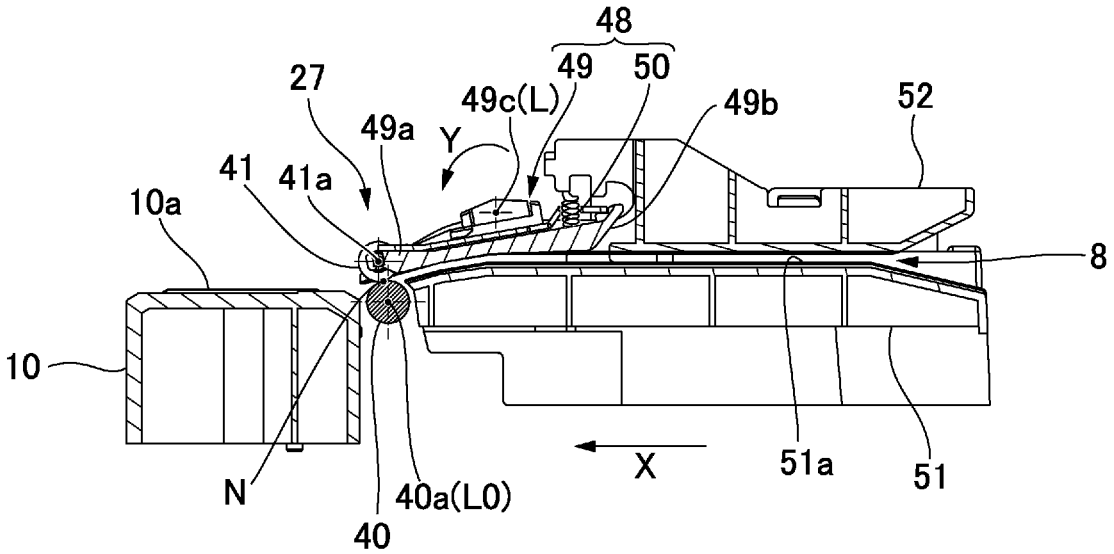
FIG. 6 is a section view of the second conveyance mechanism, top paper guide, bottom paper guide, and platen.

Mechanism Preventing Sagging of the Continuous Paper Between the Second Conveyance Mechanism and Platen FIG. 5 is an oblique view of the second conveyance mechanism 27, top paper guide, and bottom paper guide. FIG. 6 is a section view of the second conveyance mechanism 27, top paper guide, bottom paper guide, and platen 10. Note that in the following description the upstream side in the paper feed direction X denotes the upstream side of the conveyance direction when the continuous paper 2 is conveyed from the first and second conveyance mechanism 26, 27 side to the platen 10; and the downstream side in the paper feed direction X denotes the downstream side of the same conveyance direction.

As shown in FIG. 6, a bottom paper guide 51 located below the conveyance path 8, and a top paper guide 52 located above the conveyance path 8, are disposed between the first conveyance mechanism 26 and second conveyance mechanism 27. The bottom paper guide 51 extends to near the paper feed roller 40. The top paper guide 52 is disposed above a part of the bottom paper guide 51 separated from the paper feed roller 40. The top 51*a* of the bottom paper guide 51 is positioned above the paper feed roller 40 in the area opposite the top paper guide 52, and slopes gradually downward therefrom to the end near the paper feed roller 40. As a result, the continuous paper 2 is conveyed at a downward angle to between the paper feed roller 40 and pressure roller 41.

The paper feed roller 40 of the second conveyance mechanism 27 is a single roller that is longer than the width of the conveyance path 8, and is disposed on the upstream side in the paper feed direction X relative to the platen 10. The pressure roller 41 includes a plurality of rollers arrayed widthwise to the printer (that is, the direction of the paper width S) along the paper feed roller 40. The support mechanism 48 that supports the pressure roller 41 includes a paper pressing lever 49 disposed above the conveyance path 8, and a support frame (not shown in the figure) that pivotably supports the paper pressing lever 49. The support frame is formed in unison with the top paper guide 52, for example. As shown in FIG. 6, the paper pressing lever 49 extends along the top 51*a* of the bottom paper guide 51 near the paper feed roller 40. There are plural paper pressing levers 49 disposed along the plural pressure rollers 41 (across the printer width/paper width S). Two pressure rollers 41 are rotatably supported on the platen 10 side end 49*a* of each paper pressing lever 49. In this example there are eight pressure rollers 41 disposed along the paper feed roller 40, and to support these there are four paper pressing levers 49 disposed across the width of the printer. Note that a configuration having the same number of pressure rollers 41 as paper pressing levers 49 with one pressure roller 41 attached to each paper pressing lever 49 is also conceivable.

The support mechanism 48 also has a spring 50 (urging member) that urges the paper pressing lever 49 in the direction pressing the pressure rollers 41 to the paper feed roller 40. The bottom end of the spring 50 is attached to the top paper guide 52 side end 49*b* of the paper pressing lever 49. The top end of the spring 50 is attached to the top paper guide 52. The paper pressing lever 49 is supported by the support frame (or the top paper guide 52) so that the paper pressing lever 49 can rock on a pivot point 49*c* near the middle between the ends 49*a*, 49*b*. The pivot points 49*c* of the four paper pressing levers 49 are all aligned on the same axis of rotation L. This axis of rotation L is parallel to the axis of rotation L0 of the paper feed roller 40. The four paper pressing levers 49 can rock independently of each other around this axis of rotation L.

The end 49*a* of the paper pressing lever 49 is urged to the paper feed roller 40 side (down) by the urging force of the spring 50. As a result, the pressure roller 41 attached to the end 49*a* pushes the continuous paper 2 from above to the paper feed roller 40. The pivot point 49*c* of the paper pressing lever 49 is located above the conveyance path 8 on the opposite side of the axis of rotation 40*a* of the paper feed roller 40 as the platen 10, that is, on the upstream side in the paper feed direction X. The length of the paper pressing levers 49 is set so that the downstream end 49*a* extends to the platen 10 side from directly above the paper feed roller 40. Therefore, when the paper pressing lever 49 is pivoted in the urging direction Y by the spring 50, the pressure roller 41 is pressed to the paper feed roller 40 from diagonally above (at an angle from the platen 10 side) instead of directly above the paper feed roller 40.

The second conveyance mechanism 27 disposes the paper feed roller 40, pressure roller 41, and support mechanism 48 so that the nipping position N of the carriage guide shaft 20 by the pressure roller 41 and paper feed roller 40 is positioned on the platen 10 side from directly above the axis of rotation 40*a* and higher than the platen surface 10*a*. The direction of the tangent to the nipping position N is therefore not horizontal, but instead descends diagonally to the platen 10 at slope determined by the direction of the tangent (FIG. 7). Therefore, when the continuous paper 2 is conveyed in the paper feed direction X, the continuous paper 2 proceeding to the platen 10 side from the nipping position N is conveyed toward the platen surface 10*a* from diagonally above the platen surface 10*a*. The continuous paper 2 is fed from diagonally above to the gap between the platen surface 10*a* and the nozzle face 11*a* of the inkjet head 11, is pressed at slope to the platen surface 10*a*, and is conveyed along the platen surface 10*a*. As a result, the continuous paper 2 is prevented from lifting away from the platen surface 10*a*.

Figure 7A:
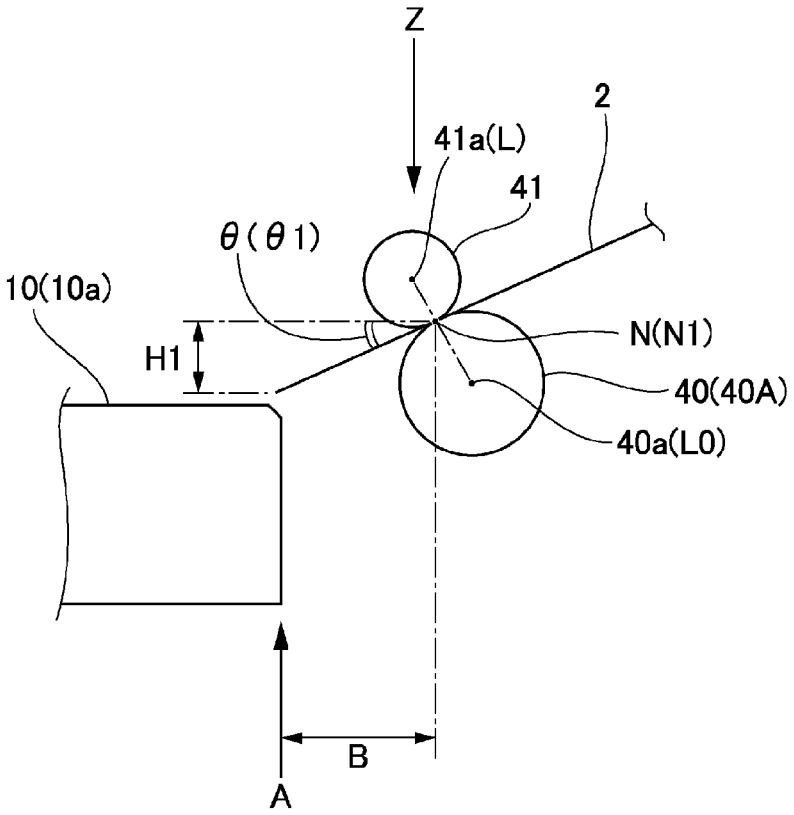
FIGS. 7A and 7B describe variation in the nipping position of the paper feed roller.
Figure 7B:
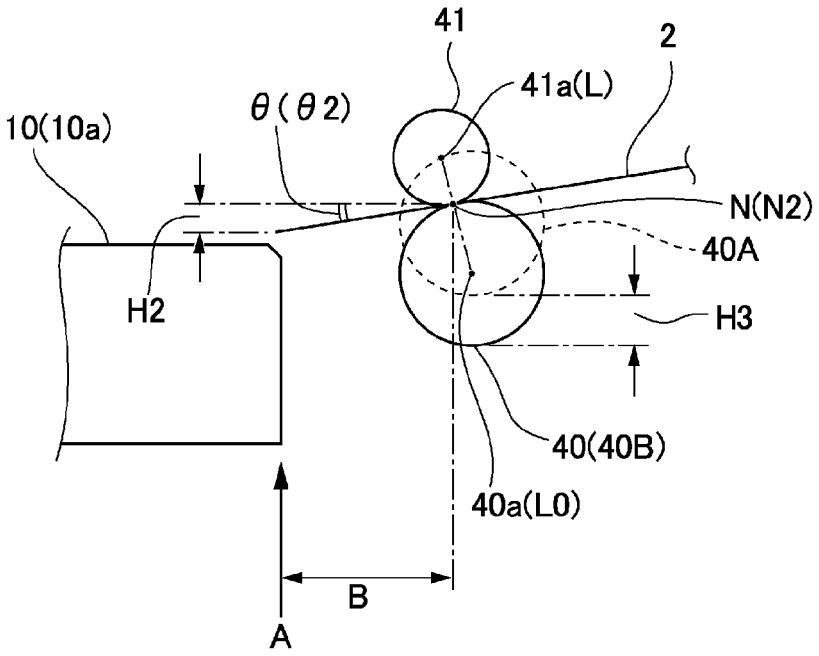

FIG. 7A and FIG. 7B describe change in the nipping position N of the paper feed roller 40, FIG. 7A showing the nipping position N1 of part 40A of the paper feed roller 40 when there is no deflection, and FIG. 7B showing the nipping position N2 of part 40B when there is downward deflection in the paper feed roller 40.

In this example the conveyance path 8 is wide and the distance between the support points at opposite ends of the paper feed roller 40 is long. The pressure from the pressure roller 41 is also increased to press the continuous paper 2 firmly against the surface of the paper feed roller 40 and increase the conveyance force. As a result, the paper feed roller 40 is greatly deflected by the pressure from the pressure roller 41 (direction Z in FIG. 7A), and the center of the paper feed roller 40 may descend greatly to the bottom side.

As shown in FIG. 7A, the nipping position N1 at part 40A of the paper feed roller 40 when there is no deflection is on the platen 10 side from directly above the axis of rotation 40*a*, and higher than the platen surface 10*a*. More specifically, the nipping position N1 is set to feed the continuous paper 2 to the platen surface 10*a* from diagonally above. The nipping position N1 is also set so that when the leading end of the continuous paper 2 conveyed at slope θ (theta) 1 in the tangential direction at the nipping position N1 reaches conveyance position A immediately before the platen 10, the leading end of the continuous paper 2 is higher than the platen surface 10*a* by an amount approximately equal to the tolerance in the height of the platen surface 10*a*.

The center of the paper feed roller 40 descends the most when the paper feed roller 40 bends due to pressure from the pressure roller 41. FIG. 7B shows the nipping position N2 of part 40B of the paper feed roller 40 when maximally deflected down. When the pressure roller 41 pushes the paper feed roller 40 down, the pressure roller 41 moves on a curved path around the pivot point 49*c* as the paper pressing lever 49 rocks. At this time, the pressure roller 41 descends while moving to the side away from the platen 10. More specifically, the nipping position N2 in the middle of the paper feed roller 40 moves to the side away from the platen 10 along the outside surface of the paper feed roller 40, tracking the movement (descent) of the paper feed roller 40 as it bends in the direction pressure is applied by the pressure roller 41. As a result, the slope θ2 of the tangent at the nipping position N2 is lower (more gradual) than the slope θ1 of the tangent when there is no deflection.

When the angle of the continuous paper 2 fed from the nipping position N2 decreases, the drop H2 of the leading end of the continuous paper 2 in conveyance period B from the nipping position N2 to conveyance position A immediately before the platen 10 is less than the drop H1 of the leading end of the continuous paper 2 in the same conveyance period B when the continuous paper 2 is fed at slope θ1 shown in FIG. 7A. More specifically, the slope of the tangent at the nipping position changes from θ1 to θ2 as a result of the nipping position moving from N1 to N2. In this example, the leading end of the continuous paper 2 moves distance Δ (delta) H (=H1−H2) in the opposite direction as the direction of paper feed roller 40 movement (down) according to the change in the slope θ of the tangent.

When the drop of the deflected part 40B of the paper feed roller 40 is H3, the second conveyance mechanism 27 moves the nipping position N so that drop H3 and ΔH are equal. More specifically, when the paper feed roller 40 descends, the leading end of the continuous paper 2 rises an amount equal to the drop H3 in the paper feed roller 40 in conveyance period B from the paper feed roller 40 to the conveyance position A immediately before the platen 10, following the drop in the paper feed roller 40. In other words, the second conveyance mechanism 27 is configured so that the height of the leading end of the continuous paper 2 at the conveyance position A immediately before the platen 10 does not change according to the vertical movement of the paper feed roller 40. Note that the second conveyance mechanism 27 could alternatively be configured so that ΔH is less than drop H3. This configuration can prevent paper jams when the leading end of the continuous paper 2 is not perfectly straight but the deflection of the paper feed roller 40 is not particularly great.

Effect of the Disclosure

As described above, the second conveyance mechanism 27 of the printer 1 according to this embodiment of the disclosure includes a paper feed roller 40 disposed on the upstream side of the platen 10, a pressure roller 41 that presses the continuous paper 2 to the paper feed roller 40, and a support mechanism 48 that supports the pressure roller 41. The support mechanism 48 supports the pressure roller 41 so that when the paper feed roller 40 bends (descends) due to the pressure from the pressure roller 41, the nipping position N of the continuous paper 2 by the pressure roller 41 and paper feed roller 40 moves to the side away from the platen 10 tracking the movement (descent) of the paper feed roller 40. The support mechanism 48 is also achieved by a simple configuration using a paper pressing lever 49.

Because the nipping position N moves to the side away from the platen 10 along the surface of a paper feed roller 40, the angle of the continuous paper 2 at the nipping position N (that is, the slope θ of the tangent at the nipping position N) changes so that the leading end of the continuous paper 2 protruding toward the platen 10 from the nipping position N rises in the opposite direction as the direction of the applied pressure Z. The leading end of the continuous paper 2 can therefore be moved (raised) in the opposite direction as the direction of the applied pressure Z when the paper feed roller 40 moves (descends) in the direction pushed Z by the pressure of the pressure roller 41. Sagging of the continuous paper 2 can therefore be reduced when the paper feed roller 40 bends and the middle drops greatly by reducing the difference in the height of middle and the sides of the continuous paper 2 before reaching the platen 10. The continuous paper 2 can therefore be prevented from catching on the platen 10, and paper jams can be prevented between the second conveyance mechanism 27 and platen 10.

When the paper feed roller 40 descends in this embodiment, the leading end of the continuous paper 2 follows this movement and rises the same distance as the drop H3 in the paper feed roller 40 in the conveyance period B from the paper feed roller 40 to the conveyance position A just before the platen 10. More specifically, the height of the leading end of the continuous paper 2 at the conveyance position A just before the platen 10 does not change due to the vertical movement of the paper feed roller 40. Sagging of the continuous paper 2 is therefore eliminated even when the paper feed roller 40 bends by keeping the height of the middle and the sides of the continuous paper 2 the same at the conveyance position A just before the platen 10. The leading end of the continuous paper 2 fed over the platen surface 10*a* is therefore parallel to the platen surface 10*a* and paper jams can be prevented.

The paper pressing levers 49 urged at different positions rock independently according to the deflection (drop) in the paper feed roller 40 at different points. The continuous paper 2 can therefore be moved in the opposite direction as the deflection (pressure direction Z) at these positions a distance corresponding to the deflection of the paper feed roller 40 at the same positions. By thus aligning the height of the continuous paper 2 at these positions, sagging of the continuous paper 2 can be reduced.

The pressure roller 41 is pressed to the paper feed roller 40 from an angle on the platen 10 side instead of from directly above the paper feed roller 40, and the nipping position N is on the platen 10 side of the axis of rotation 40*a* of the paper feed roller 40. Therefore, by feeding the recording medium at an angle toward the platen surface, the continuous paper 2 can be prevented from lifting away from the platen surface 10*a*. Dirtying the continuous paper 2 by contact with the nozzle face 11*a* can therefore be prevented.

Variations (1) The support mechanism 48 of the pressure roller 41 is embodied using a rocking paper pressing lever 49 in the embodiment described above, but the same action can be achieved in the pressure roller 41 using a different mechanism. For example, a configuration that has curved guide channels supporting the opposite ends of the pressure roller 41 shaft, and urges the roller shaft toward one end of the guide channel, is also conceivable.

(2) The first conveyance mechanism 26 is disposed before the second conveyance mechanism 27, and the continuous paper 2 is fed toward the second conveyance mechanism 27 by the first conveyance mechanism 26 in the embodiment described above, but the disclosure can also be applied in a printer that does not have the first conveyance mechanism 26. The disclosure can also be applied to a printer that uses cut-sheet paper as the recording medium.

The disclosure being thus given, it will be apparent to those skilled in the art based on the foregoing description that it may be varied in many ways. Such variations are not to be regarded as a departure from the spirit and scope of the disclosure; rather, all such variation or modifications as would be obvious to one skilled in the art are intended to be included within the scope of the following claims.

What is claimed is:

1. A printer comprising:

a printhead;

a platen opposite the printhead; and a paper feed mechanism that conveys a recording medium between the printhead and the platen, the paper feed mechanism including a paper feed roller disposed on an upstream side of the platen in the conveyance direction, a pressure roller that presses the recording medium to the paper feed roller to nip the recording medium at a nipping position, and a support mechanism that supports the pressure roller, wherein the paper feed roller is configured to move in the direction of pressure applied by the pressure roller; and wherein, when the paper feed roller moves in the direction of pressure applied by the pressure roller, the support mechanism is configured to move the nipping position of the recording medium along the outside surface of the paper feed roller to the side away from the platen following the movement of the paper feed roller.

2. The printer described in claim 1, wherein:

the support mechanism includes a paper pressing lever to which the pressure roller is attached and which is supported pivotably on an axis of rotation parallel to the axis of rotation of the paper feed roller, and an urging member that urges the paper pressing lever in the direction pressing the pressure roller to the paper feed roller.

3. The printer described in claim 1, wherein:

the nipping position is on the platen side of the axis of rotation of the paper feed roller; and the recording medium is conveyed toward the platen in the direction of the tangent to the paper feed roller at the nipping position.

4. The printer described in claim 3, wherein:

when the paper feed roller moves in the pressure direction of the pressure roller, the recording medium at the paper feed position directly before the platen moves opposite the pressure direction an amount corresponding to the amount of change in the direction of the tangent accompanying change in the nipping position; and the support mechanism supports the pressure roller so that the movement of the recording medium at the paper feed position directly before the platen in the direction opposite the pressure direction due to change in the nipping position is equal to the movement of the paper feed roller by the pressure roller in the pressure direction.

5. The printer described in claim 2, wherein:

a plurality of pressure rollers are disposed along the paper feed roller;

a plurality of paper pressing levers are aligned and disposed in the same direction that the plural pressure rollers are disposed;

the plurality of paper pressing levers pivot on the same axis of rotation, each pressing lever pivoting independently; and each of the plurality of pressure rollers is attached to one of the plurality of paper pressing levers.

* * * * *